US007887468B2

(12) United States Patent
Ross et al.

(10) Patent No.: US 7,887,468 B2
(45) Date of Patent: Feb. 15, 2011

(54) RESISTANCE SYSTEM FOR FITNESS EQUIPMENT

(75) Inventors: Glenn D. Ross, Marietta, GA (US); Brad R. Olschansky, Roswell, GA (US); Scott M. Olschansky, Roswell, GA (US); Kevin G. Abelbeck, Fort Collins, CO (US)

(73) Assignee: Exersmart, LLC, Roswell, GA (US)

( * ) Notice: Subject to any disclaimer, the term of this patent is extended or adjusted under 35 U.S.C. 154(b) by 0 days.

(21) Appl. No.: 12/176,017

(22) Filed: Jul. 18, 2008

(65) Prior Publication Data

US 2009/0023561 A1 Jan. 22, 2009

Related U.S. Application Data

(63) Continuation-in-part of application No. 12/146,068, filed on Jun. 25, 2008.

(60) Provisional application No. 60/929,990, filed on Jul. 20, 2007.

(51) Int. Cl.
*A63B 21/00* (2006.01)

(52) U.S. Cl. ..... 482/92

(58) Field of Classification Search ..... 482/92–94, 482/99, 101, 107, 121, 129, 130, 133, 135, 482/136, 138
See application file for complete search history.

(56) References Cited

U.S. PATENT DOCUMENTS 4,666,149 A * 5/1987 Olschansky et al. ..... 482/130
5,074,551 A * 12/1991 Olschansky et al. ..... 482/137
5,522,784 A * 6/1996 Grant ..... 482/130
5,839,997 A 11/1998 Roth et al.
5,876,313 A 3/1999 Krull
6,015,367 A * 1/2000 Scaramucci ..... 482/5
6,033,350 A * 3/2000 Krull ..... 482/98
6,045,491 A * 4/2000 McNergney et al. ..... 482/121
6,186,927 B1 2/2001 Krull
6,422,979 B1 7/2002 Krull
6,540,650 B1 4/2003 Krull
6,669,606 B2 12/2003 Krull
D508,628 S 8/2005 Crawford et al.
7,077,791 B2 7/2006 Krull
7,121,988 B2 10/2006 Walkerdine
D540,405 S 4/2007 Crawford et al.
D540,894 S 4/2007 Crawford et al.
7,261,678 B2 8/2007 Crawford et al.
7,563,213 B2 * 7/2009 Grant ..... 482/129
2002/0055426 A1 * 5/2002 Krull ..... 482/98
2005/0085351 A1 * 4/2005 Kissel ..... 482/94
2006/0105889 A1 * 5/2006 Webb ..... 482/94

* cited by examiner

*Primary Examiner*—Loan Thanh
*Assistant Examiner*—Shila Abyaneh
(74) *Attorney, Agent, or Firm*—Rosenberg, Klein & Lee

(57) ABSTRACT

A resistance system for fitness equipment includes a frame, a resistance source such as an elastic cord, coil or any other type of spring, weight, pneumatic or hydraulic cylinders. The resistance source is mounted to a resistance block with a load support. A support disk is provided that is movably mounted to the frame and adapted to enable selective engagement with the load support. A transmission member, including a pliable member such as a cable, belt or other member, is coupled to the resistance source. Movement of the support disk enables selective engagement of the resistance source. In this way one or more individual resistance sources can be selectively engaged or disengaged to vary the resistance to the user by actuation of a dial or other actuator as directed by the user.

28 Claims, 12 Drawing Sheets

RESISTANCE SYSTEM FOR FITNESS EQUIPMENT

CROSS-REFERENCE TO RELATED APPLICATION DATA

Priority is claimed under 35 U.S.C. §119(e) to U.S. Provisional Application No. 60/929,990, filed on Jul. 20, 2007, which is incorporated by reference herein; this application is a continuation-in-part of application Ser. No. 12/146,068 filed on Jun. 25, 2008 also entitled "Resistance System for Fitness Equipment."

FIELD OF THE INVENTION

The present invention generally relates to fitness equipment and, more particularly, to a system for altering the resistance in an exercise device.

BACKGROUND OF THE INVENTION

Increased convenience and efficiency are hallmarks of value in many products. Fitness equipment is no different. Resistance type fitness equipment has repeatedly been shown to provide numerous benefits including increased bone density, increased lean tissue mass and also some cardiovascular benefits. A desirable aspect of fitness equipment is the ability to change the resistance. Users need to increase resistance as they progress in an exercise program thereby the machine must be able to provide a variability in resistance settings. Ease of use and the ability to quickly change resistance are important in that some exercise programs require resistance changes with minimal down time. General ease of operation is always desirable but in fitness equipment and especially resistance or strength equipment it is highly desirable.

It should therefore be appreciated that there is a need for an adjustable resistance setting device that allows for actuation of a dial or other actuation system to simply, easily and reliably change the resistance settings in an exercise device. The present invention fulfills this need and others.

SUMMARY OF THE INVENTION

The present invention provides a resistance system for fitness equipment. This includes a frame, a resistance source coupled to a resistance block, a support disk movably mounted to the frame and adapted to enable selective engagement with the resistance block. A carriage may be provided that is movably mounted to the frame and coupled to the resistance source and a transmission member with a first end coupled to the carriage and a second end adapted to be engaged by a user. The transmission member can be rigid or a pliable member and in one embodiment it may be coupled to a lower portion of the carriage. The second end of the transmission member may be engaged by the user directly as by use of a handle mounted to the end of the transmission member or indirectly as would be the case when the transmission member mounts to a secondary system such as a gearbox or other transmission, of which the user engages. In another embodiment of the invention the carriage may include a handle or other user interface so that the carriage is moved directly by the user.

The resistance source of the resistance system may be a device selected from the group including a weight block, an elastic cord, a spring, a pneumatic cylinder or a hydraulic cylinder. The resistance source may be a single element or comprised of a plurality of resistance elements. The plurality of resistance elements may include at least one element with the resistance capacity of twice that of another resistance element. The plurality of resistance elements may include an element with twice the resistance capacity relative to the lowest resistance capacity element and every other resistance element has twice the resistance capacity of the next lower capacity resistance element.

The resistance block of the resistance system for exercise may include a load support adapted to be received by a disk lip on the support disk. In addition, the resistance system may further include a plurality of support disks on a common shaft, the shaft rotatably mounted to the frame.

In another form of the invention a method of exercise is also disclosed. This method includes providing the device as stated above and the steps of moving the support disk to engage a resistance block with the support disk and then actuating the carriage with respect to the frame so as to displace a portion of the resistance source. This provides a resistance to movement of the carriage at the user interface.

For the purposes of summarizing the invention and the advantages achieved over the prior art, certain advantages of the invention have been described herein. Of course, it is to be understood that not necessarily all such advantages can be achieved in accordance with any particular embodiment of the invention. Thus, for example, those skilled in the art will recognize that the invention can be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following description of the preferred embodiments and drawings, the invention not being limited to any particular preferred embodiment (s) disclosed.

BRIEF DESCRIPTION OF THE DRAWINGS

Embodiments of the present invention will now be described, by way of example only, with reference to the following drawings, in which.

DETAILED DESCRIPTION OF THE INVENTION

Figure 2:
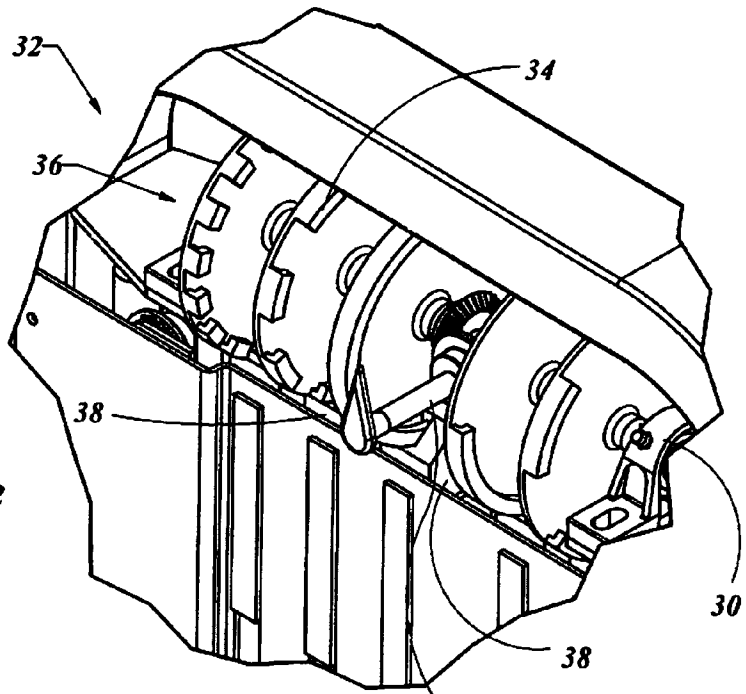
FIG. 2 is a detail of the top section of the base of an exercise device of FIG. 1 along line 2-2.
Figure 1:
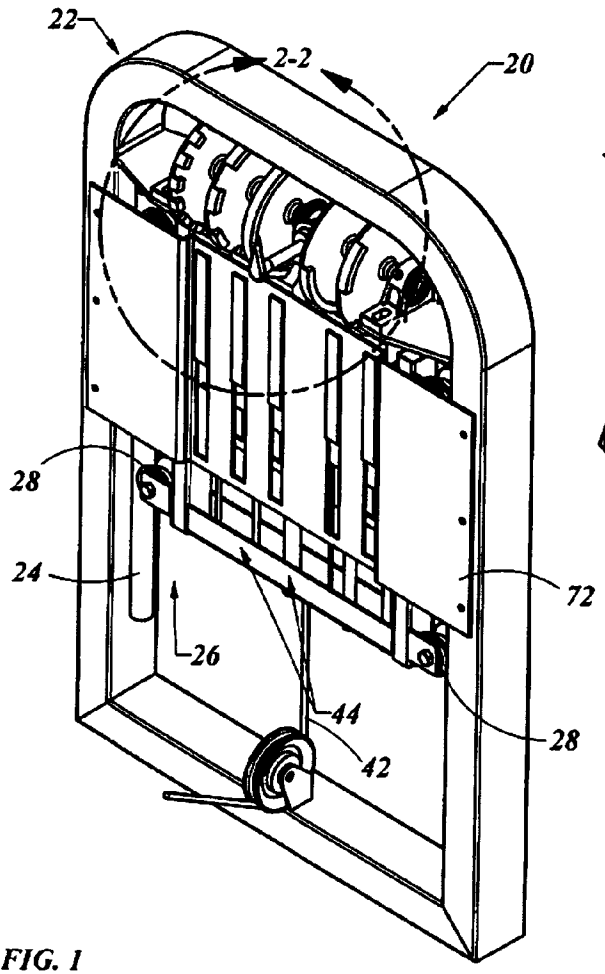
FIG. 1 is an isometric front view of a base of an exercise device incorporating a resistance system in accordance with the present invention.

With reference to the figures, and particularly to FIGS. 1-12, there is shown a first embodiment of a base of an exercise device 20. In this embodiment, device 20 includes a frame 22 and two rails 24. The rails 24 enable proper tracking of the carriage 26 relative to the frame 22. In this embodiment this is accomplished by four carriage rollers 28 mounted to each of four corners of the carriage 26 and rolling on the rails 24. The specifics of this tracking system are not considered critical to the novelty of the invention. It is understood that this is one embodiment of this assembly but other methods such as linear bearings, linear slides and glide bushings could also be used without taking away from the spirit of the invention.

Figure 4:
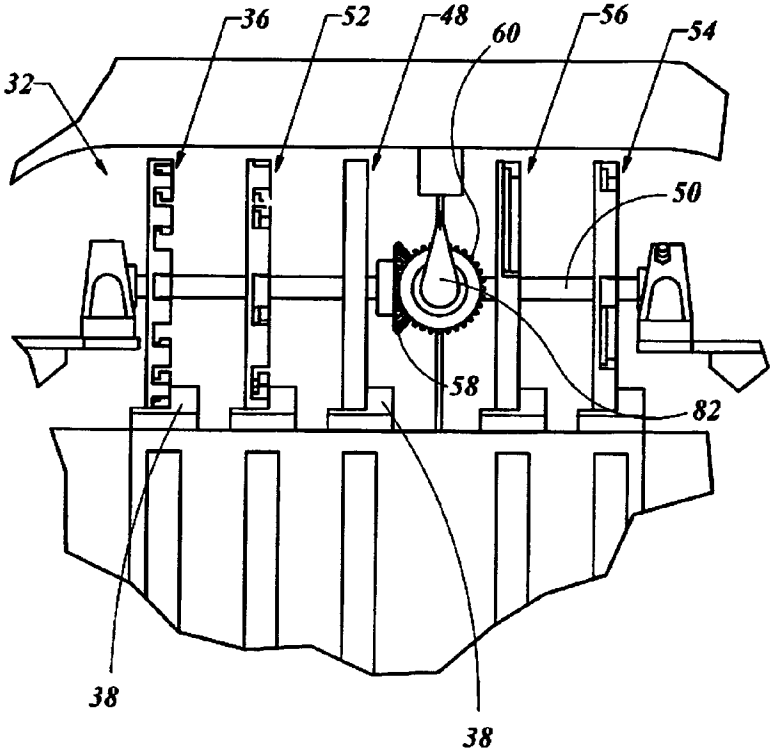
FIG. 4 is a detail of the top portion of the device shown in FIG. 3 along line 4-4.

Two bearings 30 are supported on the frame 22 and more clearly shown in FIGS. 2 and 4. These bearings 30 provide a means for movable support of a support disk assembly 32 on the frame 22. In this embodiment the support disk assembly 32 is comprised of five support disks, each with at least one disk lip 34. A first disk 36 includes a plurality of disk lips 34 spaced about the perimeter of the disk 36. The purpose of each disk lip 34 is to engage with a portion of a resistance block 38. When the disk lip 34 engages a block lip 40, that resistance block 38 is supported by the frame 22 through the support disk assembly 32. A carriage 26 can be displaced down by applying tension to a cable 42. A resistance against this movement is provided by resistance cords 44 secured to a resistance block 38, in which the disk lip 34 and block lip 40 are engaged. Any resistance blocks 38 in which their respective disk lip 34 is not engaged with a block lip 40 will be allowed to freely move down with the carriage 26 when tension is placed on the cable 42. The cords 44 that are not supported by a disk lip 34 will not be elongated and therefore not add any tension to the cable 42, as can be also seen in FIGS. 5 and 6.

Figure 3:
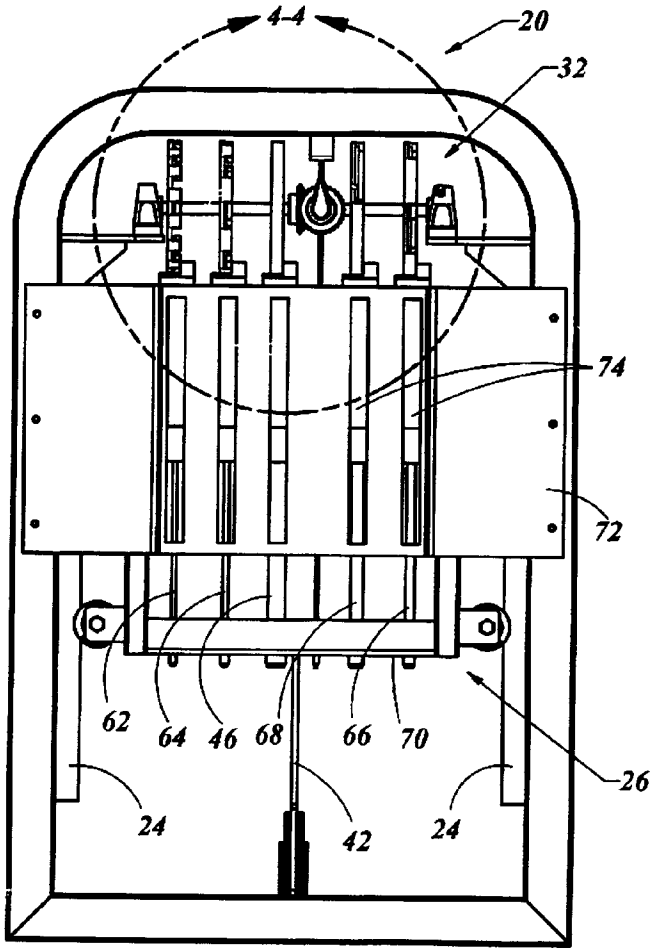
FIG. 3 is a front view of the base of the exercise device of FIG. 1.

In FIG. 3 a front view of the mechanism is shown. The support disk assembly 32 includes five disks, each with a corresponding resistance block 38 and cord. In this embodiment the resistance cords 44 are configured according to the formula: $T_N=(T_{N-1})*2$. As an example, if $T_1=F$, then $T_2=T_1*2$ and $T_3=T_2*2$ and so on, where $T_1$ through $T_N$ are the tensions generated by elastic properties of the associated cords 44. The lowest tension (F) is represented by $T_1$. Each higher tension is represented by the following higher numbers, in this case $T_2$, $T_3$ through $T_5$. Each higher resistance cord ($T_2$, $T_3$, etc) provides twice the tension of the cord of the preceding lower tension (i.e. $T_3=T_2*2$). This provides a system with $2^N$ number of increments or $(2^N-1)$ number of increments when not counting zero resistance, where "N" is the number of cords and the value of the increments is the value of $T_1$ (or F). For example, a four

TABLE 1

| $T_1$ (10 lbs) | $T_2$ (20 lbs) | $T_3$ (40 lbs) | $T_4$ (80 lbs) | Total Force |
|---|---|---|---|---|
| — | — | — | — | 0 |
| 10 | — | — | — | 10 |
| — | 20 | — | — | 20 |
| 10 | 20 | — | — | 30 |
| — | — | 40 | — | 40 |
| 10 | — | 40 | — | 50 |
| — | 20 | 40 | — | 60 |
| 10 | 20 | 40 | — | 70 |
| — | — | — | 80 | 80 |
| 10 | — | — | 80 | 90 |
| — | 20 | — | 80 | 100 |
| 10 | 20 | — | 80 | 110 |
| — | — | 40 | 80 | 120 |
| 10 | — | 40 | 80 | 130 |
| — | 20 | 40 | 80 | 140 |
| 10 | 20 | 40 | 80 | 150 |

cord system with 10 pounds as the first cord would have 15 increments ($2^4-1=15$) or 16 increments counting zero. One example of the cords and loads are presented in Table 1.

With every increase in the number of cords the total number (including zero tension) of load combinations doubles. With 5 cords there are $2^5$ or 32 combinations. With six cords counting zero there are $2^6$ or 64 combinations. Whatever increment value is chosen to start ($T_1$) will be the tension or force increment. For example if $T_1=5$ pounds, then the range would be 0 to 75 pounds with four cords in this arrangement. If $T_1=20$ pounds then the sixteen increments of resistance would be 0 to 300 pounds. By adding one 160 pound cord as the fifth ($T_5$) to the previously mentioned four cord system with ten pound increments, the range would be 0 to 310 pounds with thirty-two different settings in ten-pound increments. In the system as described, a great deal of variety and range in resistance can be achieved with a small number of resistance cords. This system is disclosed with resistance cords only, but the same system can be used with a number of resistance sources including weights, springs, pneumatic and hydraulic cylinders, or any spring material and configuration which allows for the storage of mechanical energy stretching, bending, twisting or other physical deformation.

The disks of the assembly 32 in FIGS. 3 and 4 are positioned with the associated highest resistance cord 46 nearest the center of the carriage 26. This is desirable in that it minimizes the load in the tracking system of the carriage 26 but is not mandatory to the function of the invention. The fifth disk 48 has a common shaft 50 with the first disk 36. Likewise the second disk 52, third disk 54 and fourth disk 56 are also continuous with the shaft 50. A shaft gear 58 is also continuous with the shaft 50, thereby movement of the shaft gear 58 results in rotation of the shaft 50 and all the disks (36, 48, 52, 54 and 56). In this embodiment a knob gear 60 is provided that drives the shaft gear 58. This is done to allow access to the knob 82 at the front of the device 20. The location and for that matter, the presence of the shaft gear 58 and knob gear 60 are not mandatory but provided here as one embodiment of the invention. Another embodiment eliminates the shaft gear 58 and knob gear 60 and may provide a knob 82 on one or both ends of the shaft 50, so that the user may rotate the shaft 50 directly. In a comparable manner, a drive system such as an electric motor, may be attached directly to the shaft 50 or any gear 58. In this way the shaft 50 can be actuated by the push of a button somewhere on the machine or even remotely by wired or wireless connection including radio frequency (RF), infrared or any other communication known in the art. Any method of rotating the disks (36, 48, 52, 54 and 56) can be used to accomplish selection of the desired resistance.

In this embodiment the resistance blocks 38 are similar in construction in each position and adjacent to each disk (36, 48, 52, 54 and 56). Each resistance block 38 is attached to a resistance cord. As previously noted, the heaviest cord 46 is associated with the fifth disk 48. The lightest cord, cord one 62, is associated with the first disk 36, cord two 64 is associated with the second disk 52, cord three 66 with the third disk 54 and cord four 68 with the fourth disk 56. Each of the cords (46, 62, 64, 66 and 68) is secured to the carriage 26 at the bottom rail 70. Orientation of the support disk assembly 32 provides selective engagement of any or all of the resistance blocks 38 and associated cords (46, 62, 64, 66 and 68) to the frame through the disks (36, 48, 52, 54 and 56). Power is transferred to the carriage 26 by the user through the cable 42. In this embodiment the resistance block cover 72 provides additional movable support of the resistance blocks 38 as they are guided by the slots 74. This is one of any number of structural elements that may be used to guide the blocks 38 as they travel relative to the frame 22.

Figure 5:
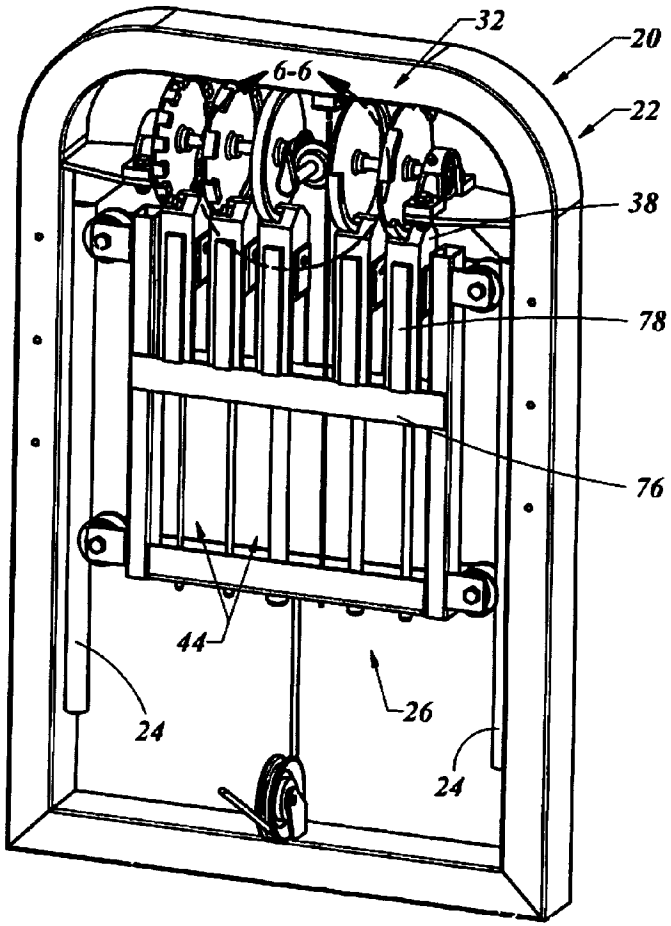
FIG. 5 is a front isometric view of the device of FIG. 1 shown with the covers removed.
Figure 6:
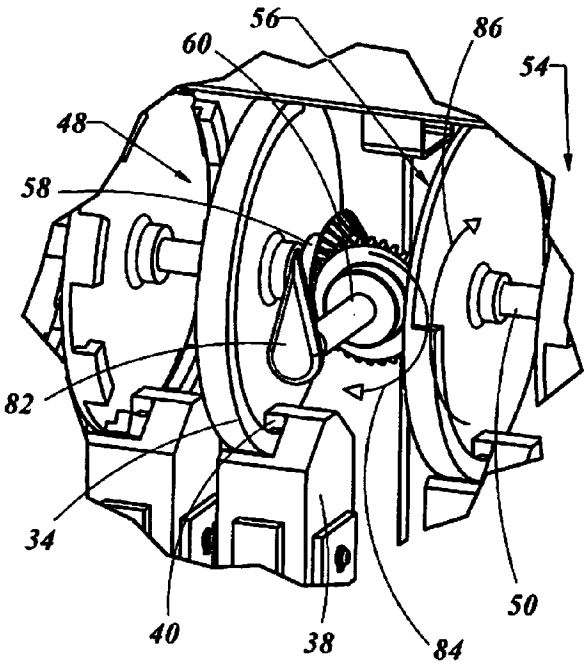
FIG. 6 is a detail of the top, center portion of the device shown in FIG. 5 along line 6-6.

More detail of the device 20 is shown in FIGS. 5 and 6 in which the resistance block covers 72 (front and back) have been removed. In this view, the carriage 26 is shown with the carriage recoil bar 76 positioned under the block rail 78 or any other portion of the resistance block 38. When a resistance block 38 is not engaged with the associated disk (36, 48, 52, 54 or 56), that resistance block 38 will move down with the carriage 26 as actuated by the cable 42. These non-engaged resistance blocks 38 will be supported by the carriage recoil bar 76 and therefore be moved back up to the disk assembly 32 when the tension is decreased from the cable 42 and the carriage moves back to its original or non-tensioned position. An optional recoil cord (not shown in this figure) may be used to pull the carriage back to the top (starting position as shown here) if no cords are used.

The engagement of the fifth disk 48 with the associated resistance block 38 is illustrated in FIG. 6. Each disk (36, 48, 52, 54 and 56) includes a disk lip 34 that enables selective engagement with the block lip 40 of the resistance block 38. The disks (48, 56, etc.) are moved in this embodiment by actuation of the knob 82, which is mounted to the knob gear 60. The knob gear 60 is in this embodiment is a beveled gear that mates with the shaft gear 58 that is continuous with the shaft 50. Thereby actuation of the knob 82 in a clockwise direction 84 causes rotation of the support disk assembly 32 in a clockwise direction 86 when viewed from the right of the machine 20 as is indicated by the arrows (84 and 86). Rotation of the shaft 50, and therefore the combination of disks (36, 48, 52, 54 and 56) such that any of the associated disk lips 34 engage with their respective block lips 40 of the resistance blocks 38, that block 38 (or combination of multiple blocks 38) will have one end of the cord 44 that is secured to that particular block 38 fixed to the frame 22 by way of the disk assembly 32. In this embodiment the cable 42 is coupled to the carriage 26 at the opposite end relative to the blocks 38. Also secured to this end of the carriage 26, are the end of the cords 44 which are opposite to the end of the cords 44 where the blocks 38 are located. The resistance to movement of the carriage 26 by way of the cable 42 is proportionate to which blocks 38, and therefore which cords 44, have their blocks 38 held by engagement with the disk assembly 32.

Figure 7:
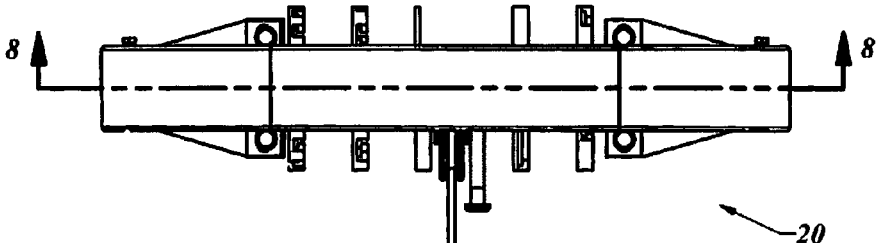
FIG. 7 is a top view of the exercise device of FIG. 1
Figure 8:
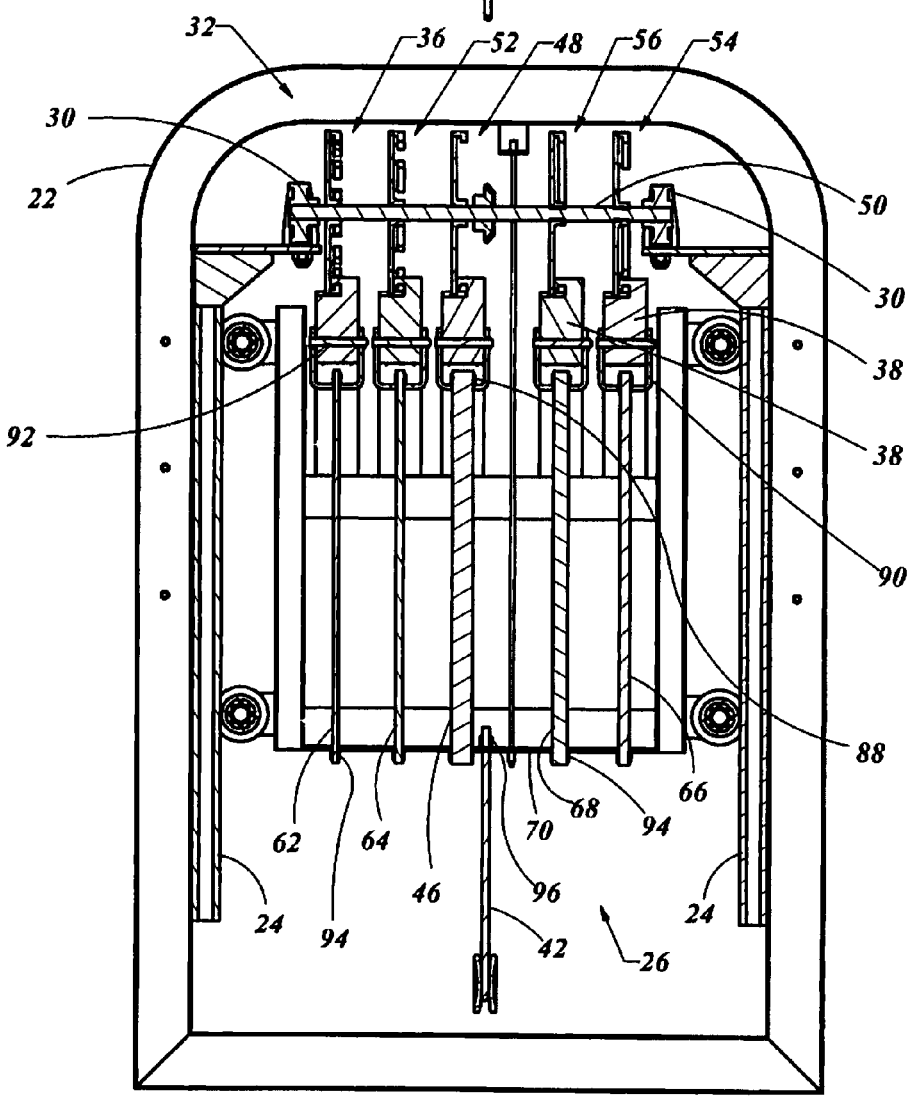
FIG. 8 is a sectioned view of the exercise device in FIG. 7 sectioned along line 8-8.

A top view of the device 20 is shown in FIG. 7 illustrating the position of the section line 8-8. This partial section view is shown in FIG. 8 with the resistance block covers 72 removed for clarity. In this view it can be seen that the resistance blocks 38 are selectively engaged with the disks (36, 52, 48, 56 and 54), which are positioned adjacent to each block 38. The blocks 38 are mounted to the appropriate cords (62, 64, 46, 68 and 66) by a crimp 88 that may be positioned through a hole in a block bracket 90. The block bracket 90 is fastened to the resistance block 38 by a pin 92 or similar fastening device. The opposite end of each cord (62, 64, 46, 68 and 66) is fastened to the end of the bottom rail 70 of the carriage 26 by a second crimp 94. The cable 42 may also be mounted to the bottom rail 70 by a cable crimp 96, thus enabling displacement of the carriage 26 from the support disk assembly 32 by tension applied to the cable 42. Any resistance blocks 38 which are secured to the adjacent disk of the support disk assembly 32 will maintain the upper position of the associated cords (62, 64, 46, 68 and 66) relative to the frame 22 while the lower end of that cord will move away from the support disk assembly 32, stretching those cords and providing resistance to movement of the carriage 26. It is understood that the invention may be positioned in any number of orientations relative to the user. This is only one version where the blocks 38 move in a vertical plane and are initially positioned near the upper portion of the frame 22. Varying the combination of cords (62, 64, 46, 68 and 66) as per their selective engagement with their respective disks (36, 52, 48, 56 and 54) will vary the force in the cable 42 similar to that noted in Table 1, only as shown here with twice the number of variations or thirty-two settings for five cords rather than sixteen settings for four cords as previously noted.

Figure 9:
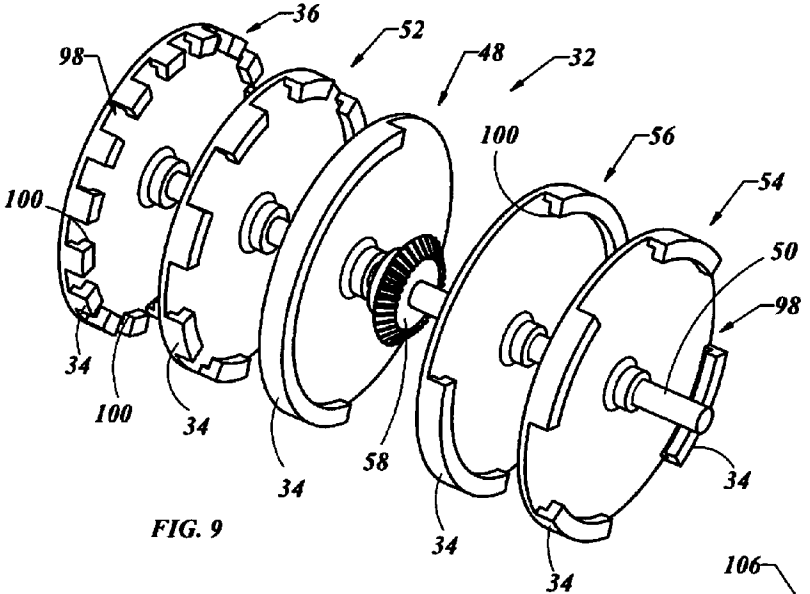
FIG. 9 is an isometric view of the support disk assembly of the exercise device of FIG. 1.

The support disk assembly 32 of this embodiment is shown in FIG. 9. In this embodiment each disk has at least one disk lip 34. The first disk 36 has sixteen disk lips 34, the second disk 52 has eight disk lips 34, the third disk 54 has four lips and the fourth disk 56 has two lips 34. The fifth disk 48 is shown to have one disk lip 34 that covers substantially half of the perimeter of the disk 48. Each of the disks is coupled to the shaft 50 for rotation therewith. This may be a molded part or a series of metal parts that are welded or assembled of this or other materials to create this assembly 32. The shaft gear 58 is also securely mounted to the shaft 50 by any method known in the art.

A variation to the invention as presented in FIG. 9 is to provide a series of disks that are similar in the size and general construction of the disk lip 34 but with the initial gap 98 positioned out of phase and in a set order. By doing this, resistance cords can be sequentially added with a set rotational displacement of the support disk assembly 32. In this variation and all forms of the invention, the resistance cords (62, 64, 46, 68 and 66) may be one tension or provided in different tensions. Also the disk portions may be half disks, quarter disks or any other portion of a full disk. Or, instead of disks, a wheel structure may be used with a hub and spokes supporting a rim. And, the rim could be annular or segmented with a rim portion at the end of each spoke.

Figure 10:
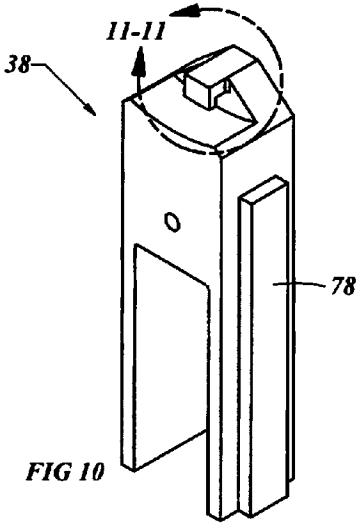
FIG. 10 is an isometric view of a resistance block of the exercise device of FIG. 1
Figure 11:
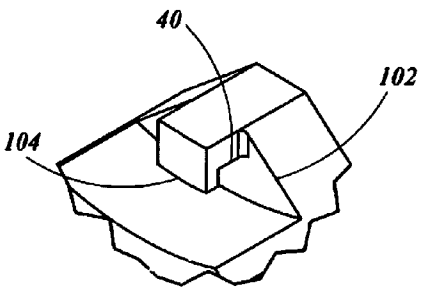
FIG. 11 is a detail view of the top portion of the resistance block of FIG. 10 along line 11-11.

A resistance block 38 is shown in FIG. 10 with more detail in FIG. 11. In this embodiment, the block 38 may include a block rail 78 which is a protrusion or other structural feature that allows guided communication with the slots 74 in the resistance block cover 72 (FIG. 3). This optional structure 78 may have many numbers of variations in size, structure and orientation to the block 38. The block lip 40 on the upper portion of the block 38 is adapted to receive the disk lip 34 to offer support to the resistance block 38 or to allow the resistance block 38 to pass through the gaps 98 between the disk lips 34. In this embodiment the disk lips 34 include a disk flange 100 that is positioned adjacent to the wall 102 of the resistance block 38. A block flange 104 may be used to provide stable support of the resistance block 38 under load when supported on a disk of the support disk assembly 32. It is understood that many variations to the disk lips 34 and block lips 40 can be made. Inserts and detents can be added to the disk assembly 32 to provide more secure indexing of the components and reduce the likelihood of inadvertent movement relative to one another when one or more of the cords (62, 64, 46, 68 and 66) are stretched and therefore the system is under load.

Figure 12:
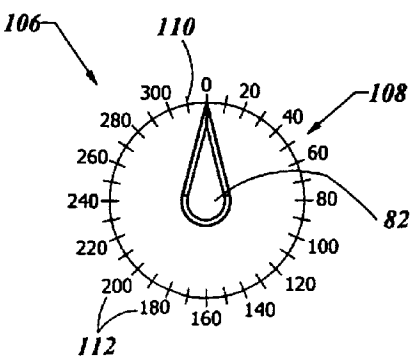
FIG. 12 is a front view of the dial knob of FIG. 1, with a dial face showing an example of the resistance settings.

A typical application of the display 106 is shown in FIG. 12. The knob 82 is positioned central to an indication display 108. The indication display 108 includes a plurality of indexing graphics such as tick marks 110 and some if not all of the load increments noted in text 112. Movement of the knob 82 to any position will be noted by a tick mark 110. That actuation rotates the shaft 50 of the support disk assembly 32 altering the engagement of the disks (36, 52, 48, 56 and 54) with the resistance blocks 38 and associated cords (62, 64, 46, 68 and 66), thus altering the tension in the cable 42 as to be overcome by the user.

As previously noted, in an alternative embodiment the knob 82 may be mounted directly to the shaft 50 of the support disk assembly 32 on one or both ends of the shaft 50. This eliminates the need for the gears (58 and 60) and in some situations could be desirable while maintaining the function as described herein.

Indexing of the knob 82, and therefore the support disk assembly 32 to be properly positioned can be accomplished in a number of methods. A spring loaded washer with an indent for every position (in this embodiment thirty-two positions) can be positioned under the knob 82 or at any place on the support disk assembly 32. In this embodiment the gears (58 and 60) have 32 teeth so a flexible element offering interference, such as a leaf spring, can be positioned to allow movement of the assembly 32, but guide it to settle at any one of the 32 settings, as opposed to settling between two settings (tick marks 110). It is understood that the detail of the load increments, methods of indexing and graphic design can change without altering the spirit of the invention.

Figure 13:
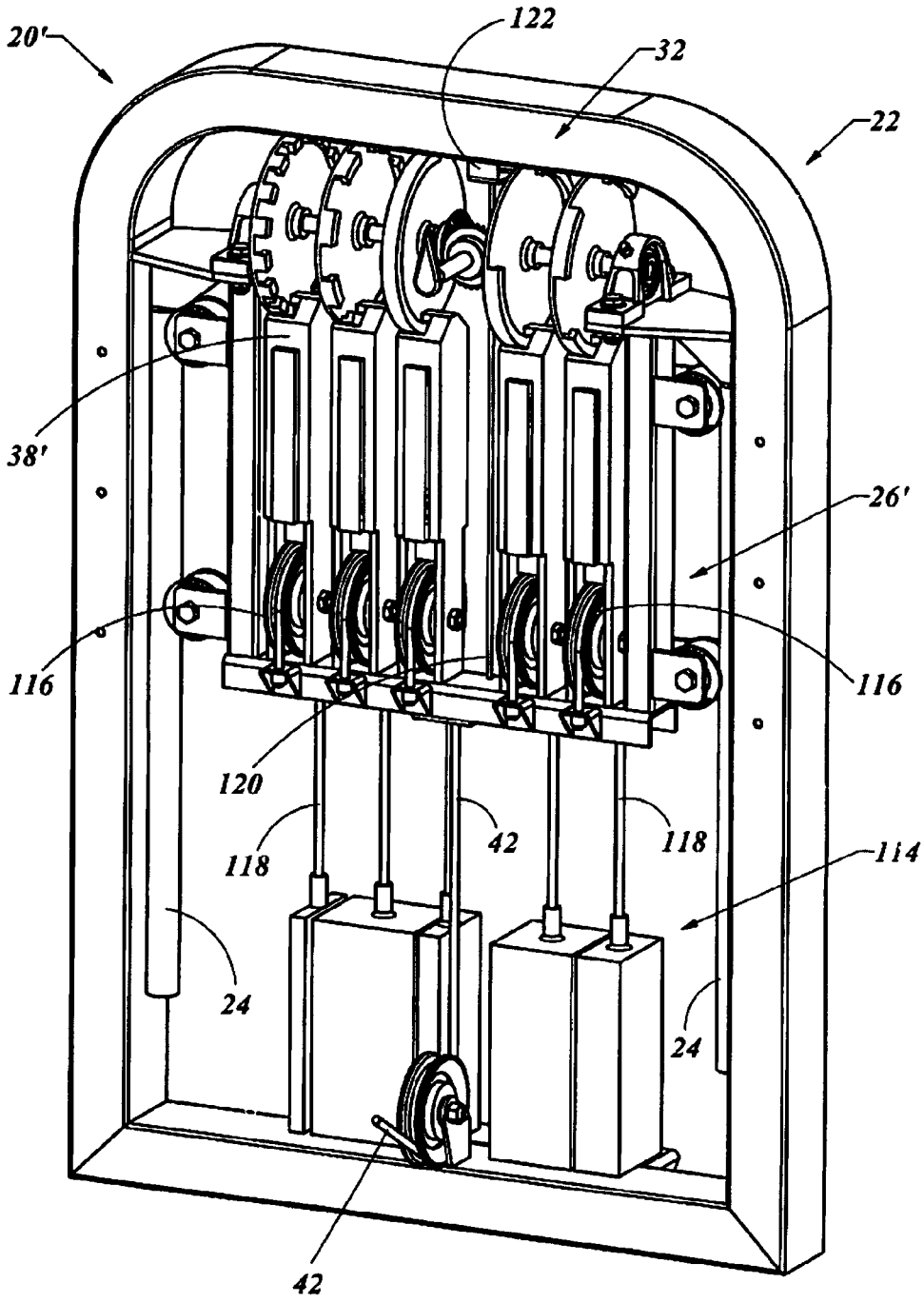
FIG. 13 is an isometric front view of a variation of the exercise device of FIG. 1 with the elastic cords removed and replaced with a weight system.
Figure 14:
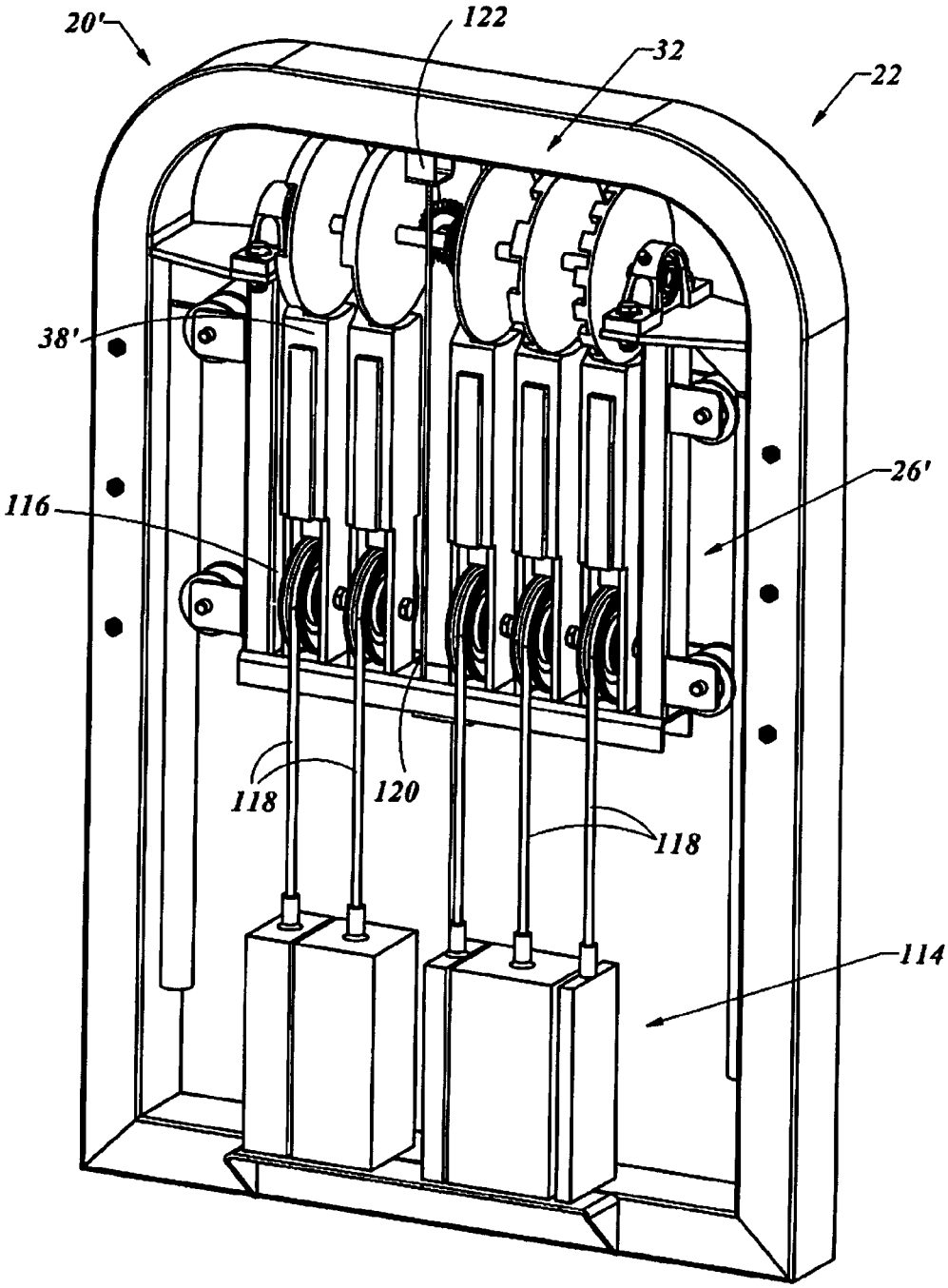
FIG. 14 is an isometric rear view of the exercise device of FIG. 13.

With reference to FIGS. 13 and 14, the device 20' is shown employing an alternate resistance system. In this embodiment the resistance cords 44 have been replaced with the weight blocks 114. The carriage 26' has been slightly modified to include a series of pulleys 116 mounted at the lower end. A weight cable 118 connects the individual weight blocks 114 to the carriage 26' by way of the respective pulley 116. A recoil spring 120 connects the bottom of the carriage 26' to the top of the frame 22 at the spring bracket 122. This spring 120 provides lift to the carriage 26' to bias it toward the elevated position shown so that the top of the modified resistance blocks 38' are properly located so as to enable selective engagement with the support disk assembly 32 as previously described. In this position shown, the system is at rest, with no tension in the cable 42.

Figure 15:
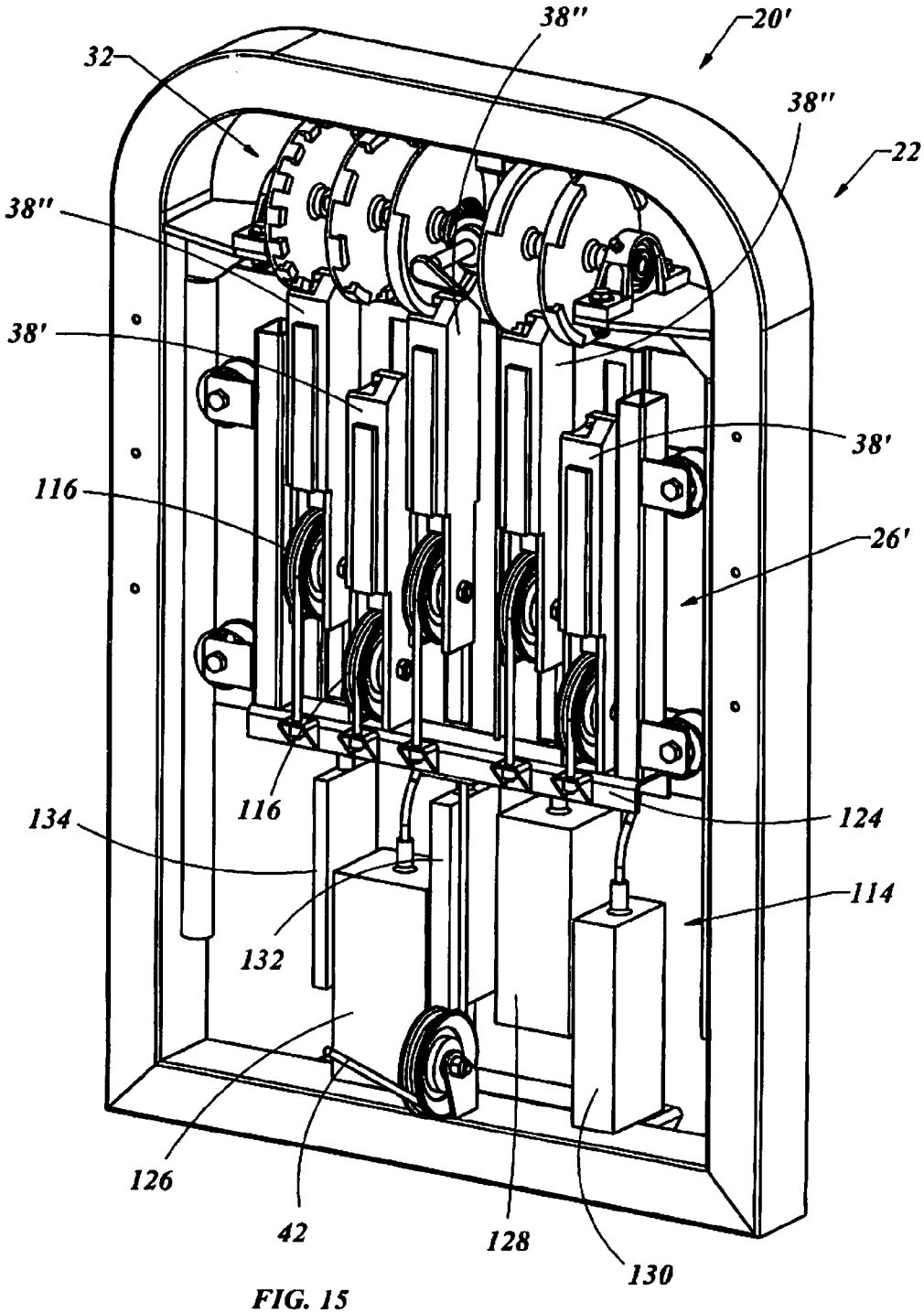
FIG. 15 is a front isometric view of the exercise device of FIG. 13 shown in use when the system is actuated.
Figure 16:
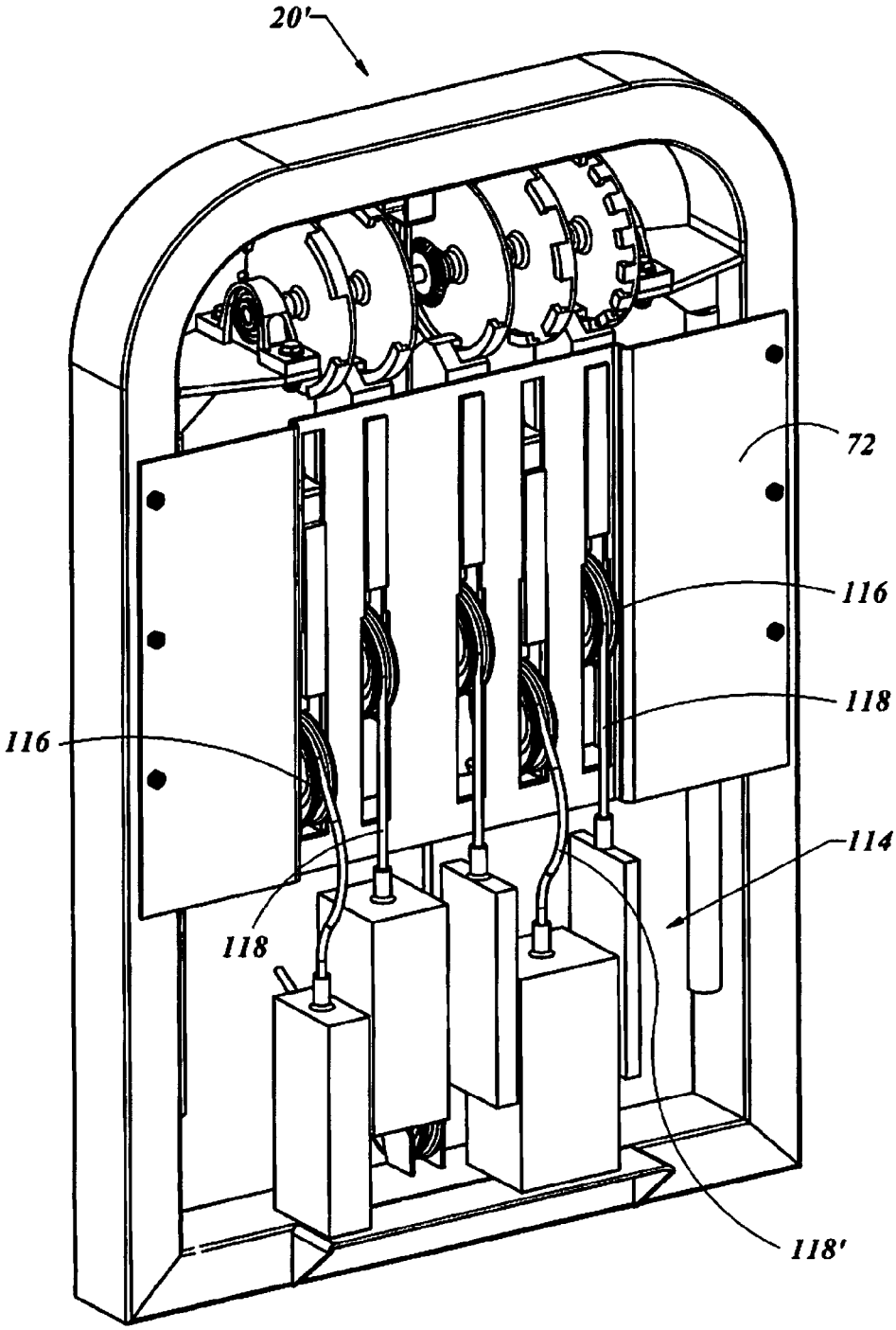
FIG. 16 is a rear isometric view of the exercise device shown in FIG. 15 with the rear block cover in place.

In FIGS. 15 and 16 the device 20' of the previous figures is shown in one example of an activated state, where tension has been applied to the cable 42 to cause the carriage 26' to be displaced down toward the bottom of the frame 22. This action increases the distance between the pulleys 116 at the bottom of the engaged modified resistance blocks 38" and the bottom frame member 124 of the carriage 26' for only those engaged resistance blocks 38" that are attached to their respective disks of the disk assembly 32. The unengaged modified resistance blocks 38' are not attached to their respective disks of the disk assembly 32 and follow with the carriage 26' as it moves away from the disk assembly 32, as they may be supported by the bottom frame member 124. This bottom frame member 124 is analogous in function to the carriage recoil bar 76 (FIG. 5) in that it supports the unengaged resistance blocks 38'. When the carriage 26' is drawn down by the tension applied to the cable 42, any pulley 116 that remains elevated displaces the respective weight block 114 up by way of the respective tight weight cable 118. The slacked weight cables 118' attached to weight blocks 114 that are not elevated, go slack in this process. Orientation of the disk assembly 32 selects which resistance blocks 38' remain elevated and which move with the carriage, thereby altering the combination of which of the weight blocks 114 are elevated and which are not elevated when the carriage 26' is moved. The combination of the mass of the weight blocks 114 lifted at any time determines the tension in the cable 42.

In these views, the weight blocks 114 are shown to be different sizes. This allows for a different amount of resistance settings. For example, if the weight block number one 126 with the greatest mass is twice that of weight block number two 128, which has twice the mass of weight block number three 130 and this continues for weight block number four 132 being twice the mass of weight block number five 134, the sequence of resistance combinations noted with the cords can also be achieved with this combination of weight blocks 114. This is not mandatory for the function of the device 20', but in some cases it may be desirable to provide the greatest number of resistance combinations in equal increasing increments with the least number of weight blocks.

Figure 19:
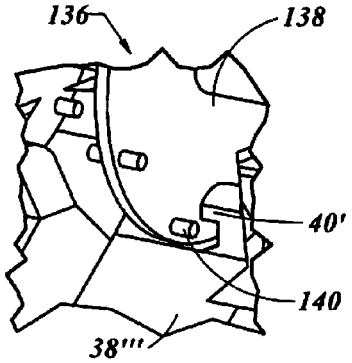
FIG. 19 is a detail view of a single disk and a modified resistance block as shown in FIG. 18 along line 19-19.
Figure 18:
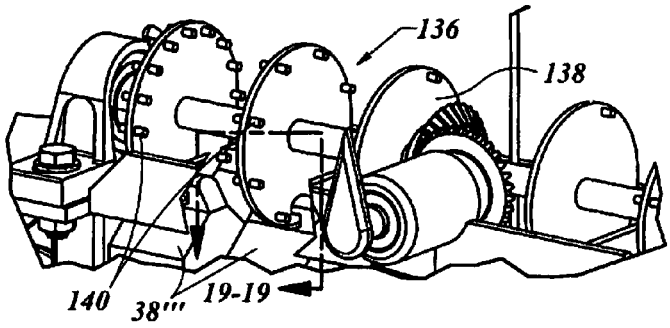
FIG. 18 is a detail view of the pin-in-disk system shown in FIG. 17 along line 18-18.
Figure 17:
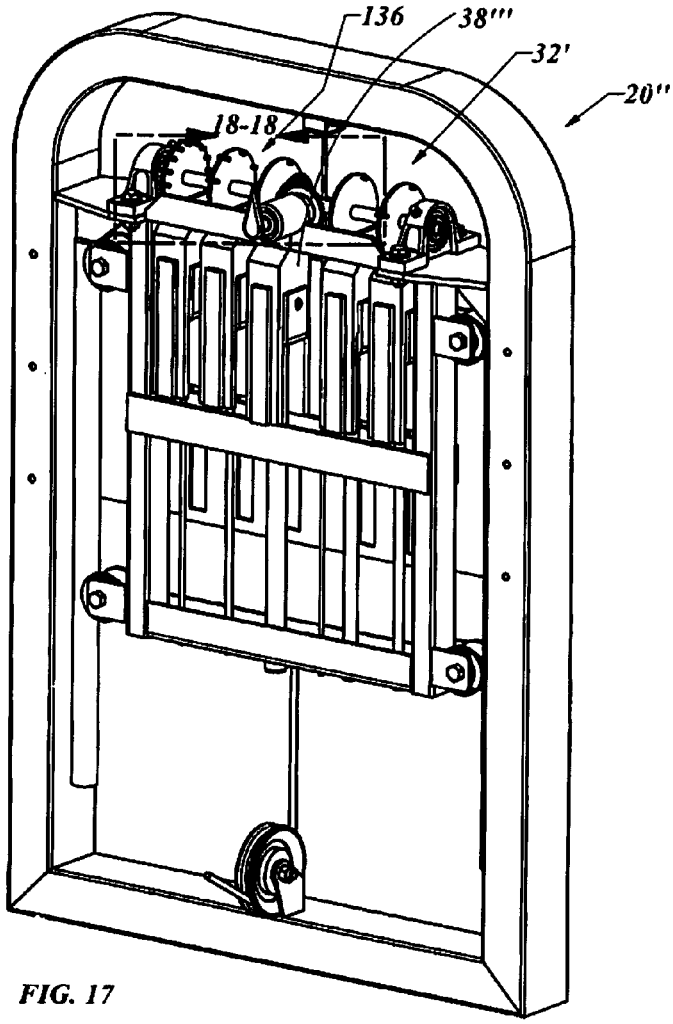
FIG. 17 is a front isometric view of a variation of the exercise device shown in FIG. 1 with a pin-in-disk system.
Figures 20, 21, 22, 23:
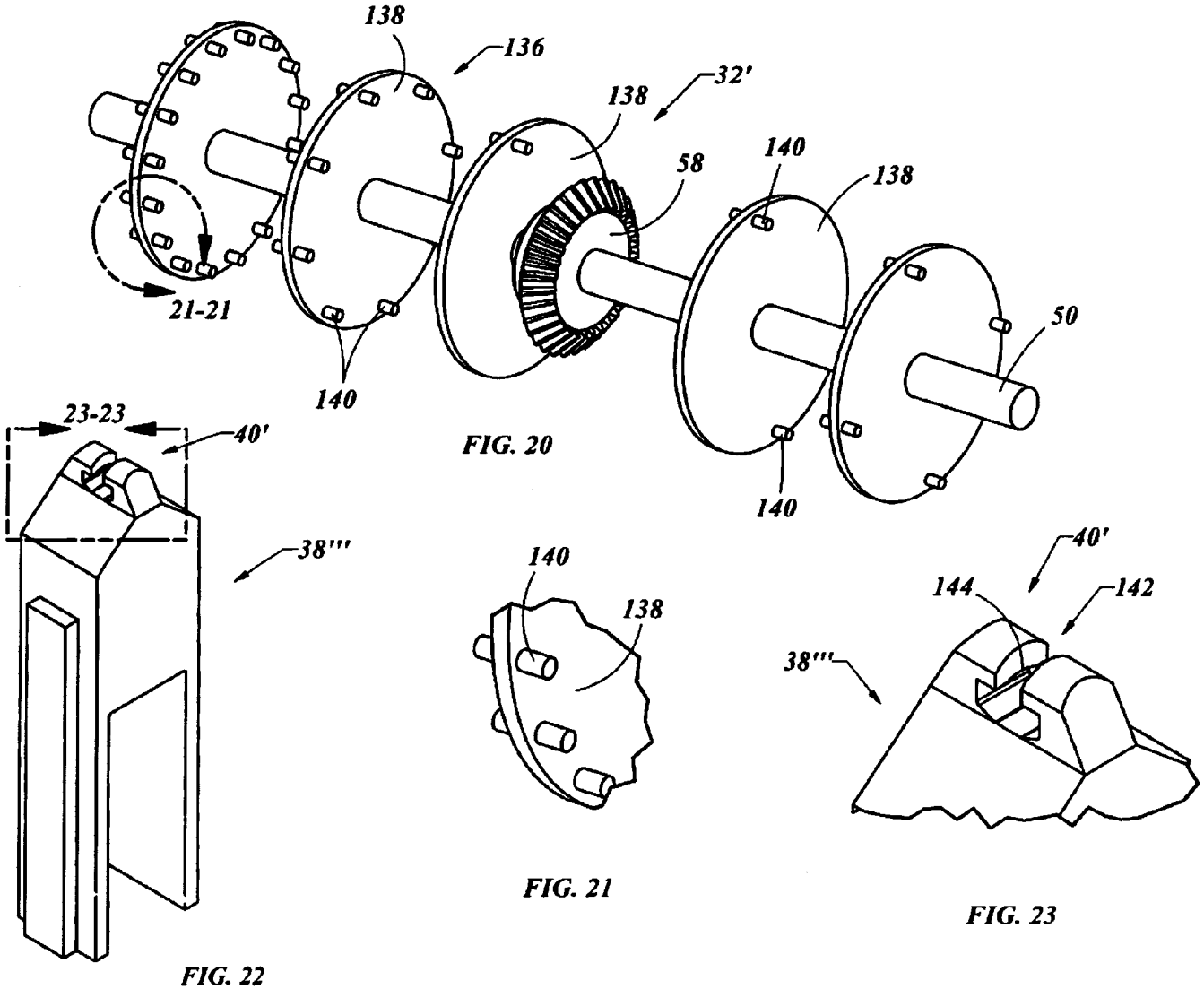
FIG. 20 is an isometric view of the pin-in-disk assembly as shown in FIG. 17.
FIG. 21 is a detail view of a portion of a disk shown in FIG. 20 along line 21-21.
FIG. 22 is a front isometric view of a modified resistance block adapted for use with the pin-in-disk system of FIG. 17.
FIG. 23 is a detail view of the top portion of the resistance block of FIG. 22 along line 23-23.

Another embodiment of the invention is shown in FIGS. 17-19. Here the device 20" is shown with a cord resistance as compared to the weight blocks, but both forms of resistance could be used in this embodiment. The variation is in the modified disk assembly 32'. A detail of the modified disk assembly 32' is shown in FIG. 18 and a detail of the interaction of the pin-in-disk system disk 136 is illustrated in FIG. 19. Referring to the drawings, the disk assembly 32' has been altered to include a substantially flat plate 138 with one or more pins 140 protruding from one or both sides of the plate 138. In this embodiment the pins 140 extend from both sides of the plate 138, as this is considered more desirable for load bearing characteristics as opposed to a cantilevered load on only one side. In some situations for clearance or assembly considerations, it may be desirable to have the pins 140 extend from only one side of the plate 138. That will be considered an understood variation of the disclosed invention.

The pin 140 is similar to the disk lip 34 of the previous embodiment of the invention 20. In this case the pin 140 provides the supportive surface necessary to engage with a recess in the block lip 40'. The curved surface of the pin 140 may provide a built in "self centering" or indexing feature that also helps prevent unintentional removal of the pin 140 from the block lip 40'. More detail of this engagement is shown in the following figures.

With reference to FIGS. 20-23, the pin-in-disk system disk assembly 32' and the resistance block 38'" are shown in detail. The disk assembly 32' includes one or more plates 138 which are each mounted to the shaft 50. Each plate 138 includes one or more pins 140 that extend from a surface of the plate 138. As a common and economical form of manufacturing, the plates 138 can be constructed of steel, aluminum, plastics or like material with holes for the shaft 50 and the pins 140. The shaft 50, pins 140 or any combination can be press fit or positioned and welded or otherwise fastened into the proper configuration, or they may be molded or casted as one part. As previously noted, a shaft gear 58 can also be positioned on the shaft 50 to enable rotational actuation of the disk assembly 32'. In all embodiments, the shaft gear 58 is used only if the orientation of the shaft 50 is desired to be different from the orientation of the axis of the knob 82. A knob 82 can also be placed on one or both ends of the shaft 50 and this gear 58 would then be eliminated.

The resistance block 38''' is similar in construction to the previously noted embodiments of the invention with, in this embodiment, a modification to the upper section including the block lip 40'. In this embodiment, the block lip 40' includes a center recess 142 adapted to accept the edge of the disk 138 and adjacent pin 140 to pass there through. If a pin 140 is positioned within the center recess 142 and the block 38''' is displaced, the pin 140 will be received by the upper structure of the block lip 40' and secured to the disk assembly 32' by the pin 140.

The shape of the contact area 144 of the block lip 40' is shown to be concave. This is to provide a self centering feature of the pin 140 when engaged with the block lip 40'. The dimensions of many aspects of the block lip 40' are subject to design variation. The displacement of the center of the contact area 144 relative to the adjacent outside edges of the block lip 40' provides an obstruction to disassociation of the pin 140, and therefore the disk assembly 32', relative to the block 38''' when a load is applied to the block 38'''. This feature helps "lock" the position of the disk assembly 32' when it is in a loaded (cords tensioned, weight blocks lifted, or any other tension system engaged) condition thereby helps to reduce the likelihood of a weight block 38''' (for example) from falling when loaded. This system can be incorporated in some form in all embodiments of the invention.

Figure 24:
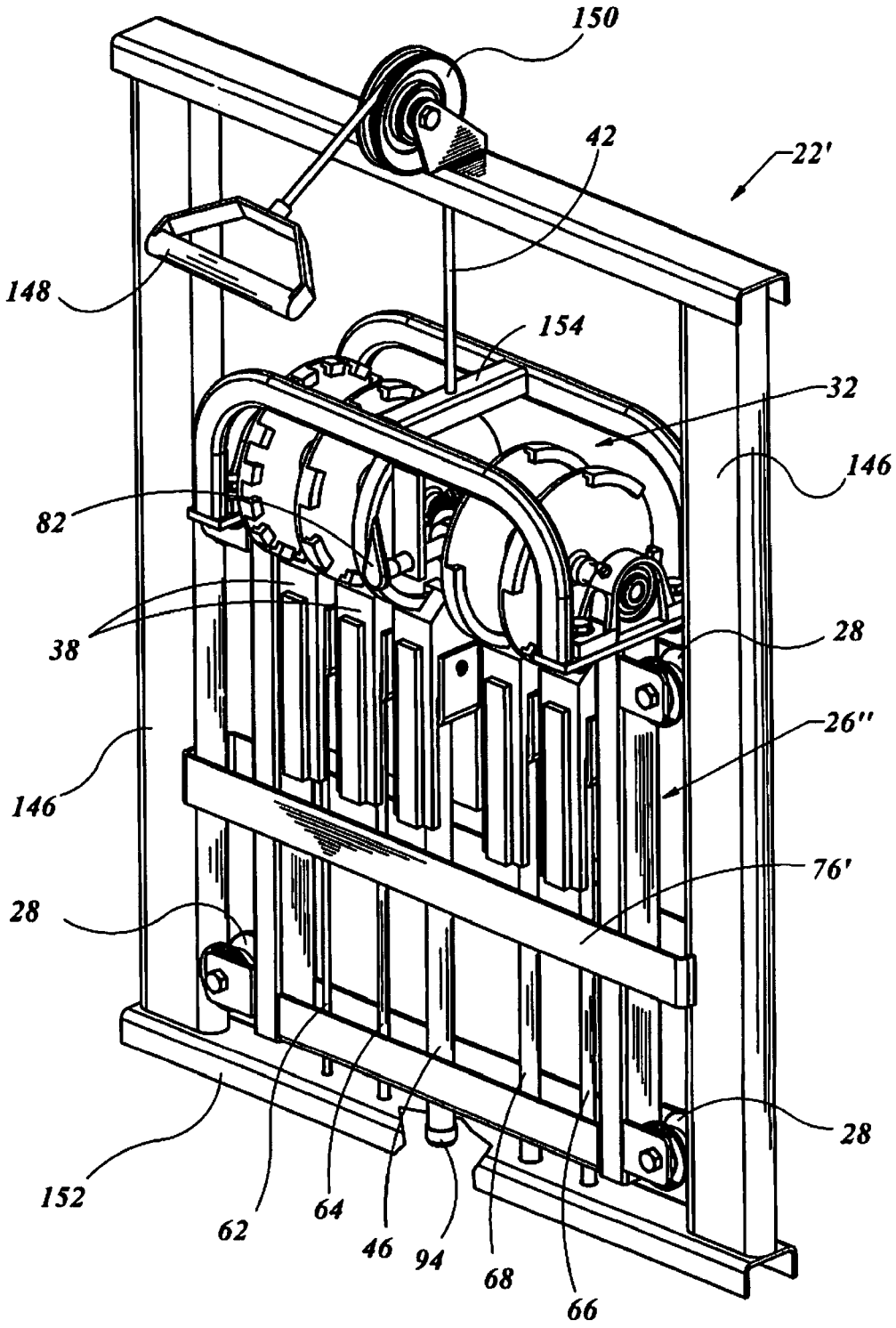
FIG. 24 is a break out isometric view of an embodiment of the invention in which the disk assembly is mounted on the movable carriage.

Another variation of the invention is shown in FIG. 24. In this form, the carriage 26" is shown slightly displaced as is the case when the cable 42 is slightly tensioned. As noted earlier, the orientation of the carriage 26" in all embodiments of the invention can be varied. When resistance cords (62, 64, 46, 68 and 66), as shown here, are used as a resistance source, or any other non-gravity based resistance source, the orientation relative to gravity makes no difference and though the carriage 26" is shown to actuate in a vertical plane, it is understood that this is not necessary to the function of the invention and is shown here as one example of that embodiment.

Given the foregoing, in this embodiment, the carriage 26" is guided by four carriage rollers 28 that articulate with a rounded edge of the vertical members 146 of the frame 22'. The round edges of the vertical members 146 are similar to the rails 24 of FIG. 1 in that they provide a guided support surface for the carriage 26" by way of the carriage rollers 28. In this embodiment relative to the previous is, in this view, the disk assembly 32 is rotatably mounted to the carriage 26". As the cable 42 is actuated by the handle 148 and pulled over the pulley 150, the carriage 26", with the disk assembly 32, moves vertically. The cords (62, 64, 46, 68 and 66) have one end secured to the slide blocks 38, as previously disclosed, and the other end is secured to the bottom frame member 152 by the crimps 94. A break out of the bottom frame member 152 shows the crimp 94 on the highest resistance cord 46. The rest of the cords (62, 64, 68 and 66) would have a similar fastening system to keep one end stationary with respect to the frame 22'

As noted, the carriage 26" is slightly actuated and therefore the cords (62, 64, 46, 68 and 66) are slightly tensioned as would be the case if all five slide blocks 38 are supported by the associated disks of the disk assembly 32 and the cable 42 is tensioned by pulling on the handle 148. The cable 42 is secured to the carriage 26" at the cross bar 154. When the tension in the cable 42 is relaxed and the carriage 26" is lowered, the slide blocks 38 are supported on the recoil bar 76'. In this embodiment the recoil bar 76' is mounted to the frame 22', but still offers support for the slide blocks 38 when the system is at rest (no tension in the cable 42) and also for any slide block 38 and associated cord (62, 64, 46, 68 and 66) that is not engaged with the associated disk of the disk assembly 32 when the carriage 26" is actuated. As before, the recoil bar 76' provides sustained positioning of the slide blocks 38 that are not engaged during movement of the carriage 26" and in doing so allows for selective engagement when the carriage 26" is returned to its resting position.

In all embodiments of the invention as shown and described herein, a rotary mounted engagement mechanism (disk assembly 32) is used to selectively engage one or more blocks 38 and their respective forms of resistance, including a cord 44 (FIGS. 1-8) or other elastic element or a weight block 114 (FIGS. 13-16). The engagement mechanism (disk assembly 32) is rotatably mounted to the frame (FIGS. 1-8 and 13-17) or rotatably mounted to the carriage (FIG. 24). In either case the disk assembly 32 enables the blocks 38 to be "directly" engaged or disengaged in a non-sequential order. For the purposes of this disclosure the term "sequential" is defined as "in order from a first end to a second end". Therefore "direct" or "non-sequential" engagement of the block 38 mounted to the (middle positioned) heaviest cord 46 with the fifth disk 48 in FIG. 8 is done "directly" without the necessity of any portion of the disk assembly 32 passing through any of the adjacent blocks 38. This direct engagement is therefore "non-sequential" in that no portion of the disk assembly 32 must first pass through or engage the adjacent blocks 38 before the block 38 associated with the desired cord 46 is reached. The direct engagement is accomplished by the existence of a disk (48 for example) that is unique to each block 38. This direct engagement reduces the probability of inadvertent engagement of a portion of the engagement mechanism with a block 38 not desired to be engaged when using a sequential engagement mechanism. The disk assembly 32 may be actuated as one structure, thereby providing all the combinations of resistances noted herein by the movement of one element. This provides efficiency and ease of use.

The foregoing detailed description of the present invention is provided for purposes of illustration and it is not intended to be exhaustive or to limit the invention to the particular embodiments shown. The embodiments may provide different capabilities and benefits, depending on the configuration used to implement key features of the invention.

What is claimed is:

1. A resistance system for fitness equipment, comprising:

a frame;

plural resistance blocks;

plural resistance devices coupled to the plural resistance blocks;

an engagement mechanism including a plurality of support disks on a common shaft rotatably mounted for selective direct engagement with specific resistance blocks of the plural resistance blocks;

a carriage coupled to the plural resistance devices and moveable relative to the frame;

a recoil bar adapted to support resistance blocks not engaged with the engagement mechanism when the carriage is displaced from a resting position; and a user interface member coupled to the carriage, whereby movement of the carriage is resisted by resistance devices that are selectively and non-sequentially engaged by the engagement mechanism.

2. The resistance system according to claim 1, wherein the plural resistance devices includes a device selected from the group consisting of a weight block, an elastic cord, a spring, a pneumatic cylinder and a hydraulic cylinder.

3. The resistance system according to claim 1, wherein the plural resistance devices includes a device with the resistance capacity of twice that of another resistance device.

4. The resistance system according to claim 1, wherein the plural resistance devices includes a device in which each device with a greater resistance capacity than the device with the lowest resistance capacity, is twice the resistance capacity of another device.

5. The resistance system according to claim 1, wherein the common shaft is rotatably mounted to the frame.

6. The resistance system according to claim 1, wherein the the common shaft is rotatably mounted to the carriage.

7. The resistance system according to claim 1, wherein the user interface member is a transmission member coupled to the carriage.

8. The resistance system according to claim 7, wherein the transmission member is a pliable member.

9. The resistance system according to claim 7, wherein the transmission member is coupled to a secondary transmission system adapted to be engaged by a user, thereby the transmission member is indirectly engaged by the user.

10. The resistance system according to claim 7, wherein a second end of the transmission member includes a handle that is directly engaged by the user.

11. The resistance system according to claim 1, wherein the carriage is directly coupled to the plural resistance devices.

12. The resistance system according to claim 1, wherein the carriage is selectively coupled to the plural resistance devices through the engagement mechanism.

13. A resistance system, comprising:

a frame;

plural resistance devices;

plural resistance blocks coupled to the plural resistance devices;

an engagement mechanism including a plurality of support disks on a common shaft rotatably mounted for selective direct engagement with specific resistance blocks;

a carriage coupled to the plural resistance devices and moveable with respect to the frame, the carriage including a user interface, whereby movement of the carriage is resisted by resistance devices that are selectively and non-sequentially engaged by the engagement mechanism; and a recoil bar adapted to support resistance blocks not engaged with the engagement mechanism when the carriage is displaced from a resting position.

14. The resistance system according to claim 13, wherein the user interface includes a transmission member.

15. The resistance system according to claim 14, wherein the transmission member includes a first end that is coupled to the carriage.

16. The resistance system according to claim 14, wherein the transmission member is a pliable member.

17. The resistance system according to claim 14, wherein a second end of the transmission member is coupled to a secondary transmission system, thereby the second end of the transmission member is indirectly engaged by a user.

18. The resistance system according to claim 14, wherein a second end of the transmission member includes a handle that is directly engaged by a user.

19. The resistance system according to claim 13, wherein the user interface is a handle.

20. The resistance system according to claim 13, wherein the plural resistance devices are selected from the group consisting of a weight block, an elastic cord, a spring, a pneumatic cylinder and a hydraulic cylinder.

21. The resistance system according to claim 13, wherein the plural resistance devices includes a device with the resistance capacity of twice that of another resistance device.

22. The resistance system according to claim 13, wherein the plural resistance devices includes a system in which each device with a greater resistance capacity, than the device with the lowest resistance capacity, is twice the resistance capacity of another device.

23. The resistance system according to claim 13, wherein the the common shaft is rotatably mounted to the frame.

24. The resistance system according to claim 13, wherein the the common shaft is rotatably mounted to the carriage.

25. The resistance system according to claim 13, wherein the carriage is directly coupled to the plural resistance devices.

26. The resistance system according to claim 13, wherein the carriage is selectively coupled to the plural resistance devices through the engagement mechanism.

27. A method of providing resistance for an exercise device of the type including a frame, plural resistance devices, plural resistance blocks coupled to the resistance devices, an engagement mechanism including a plurality of support disks on a common shaft rotatably mounted for selective direct engagement with specific resistance blocks, a carriage coupled to the plural resistance devices and moveable with respect to the frame, the carriage including a user interface and a recoil bar adapted to support resistance blocks not engaged with the engagement mechanism when the carriage is displaced from a resting position, the method including the steps of:

moving the engagement mechanism to engage selected resistance blocks;

actuating the carriage with respect to the frame so as to displace a portion of the resistance source, thereby applying a resistance to movement of the carriage at the user interface.

28. A resistance system, comprising:

an engagement mechanism including a plurality of support disks on a common shaft rotatably coupled to a frame;

plural resistance blocks with a center recess adapted to receive a portion of the engagement mechanism for selective direct engagement with specific resistance blocks of the plural resistance blocks;

plural resistance devices coupled to the plural resistance blocks;

a carriage coupled to the plural resistance blocks and movable with respect to the frame, the carriage including a user interface; and a recoil bar adapted to support the resistance blocks not engaged with, and while displaced from the engagement mechanism.

* * * * *